US008215924B2

(12) United States Patent
Lee et al.

(10) Patent No.: US 8,215,924 B2
(45) Date of Patent: Jul. 10, 2012

(54) OIL SEPARATING STRUCTURE OF VARIABLE DISPLACEMENT COMPRESSOR

(75) Inventors: Geon-Ho Lee, Seongnam-si (KR); Tae-jin Lee, Incheon (KR); Young-Chang Han, Jeonju-si (KR); Min-jun Kim, Anseong-si (KR)

(73) Assignees: Doowon Technical College, Snseing-shi, Kyonggi-do (KR); Doowon Electric Co., Ltd., Asan-shi, Chungnam (KR)

( * ) Notice: Subject to any disclaimer, the term of this patent is extended or adjusted under 35 U.S.C. 154(b) by 755 days.

(21) Appl. No.: 12/306,334

(22) PCT Filed: Jun. 30, 2006

(86) PCT No.: PCT/KR2006/002565

§ 371 (c)(1),
(2), (4) Date: Feb. 13, 2009

(87) PCT Pub. No.: WO2008/001965

PCT Pub. Date: Jan. 3, 2008

(65) Prior Publication Data

US 2009/0257890 A1 Oct. 15, 2009

(51) Int. Cl.
*F04B 1/12* (2006.01)
*F04B 1/26* (2006.01)

(52) U.S. Cl. ..... 417/269; 417/222.2; 417/271

(58) Field of Classification Search ..... None
See application file for complete search history.

(56) References Cited

U.S. PATENT DOCUMENTS

| | | | |
|---|---|---|---|
| 5,181,834 | A | 1/1993 | Ikeda et al. |
| 6,558,133 | B2 | 5/2003 | Fukanuma et al. |
| 6,675,607 | B2 | 1/2004 | Tarutani et al. |
| 7,530,797 | B2 * | 5/2009 | Ito et al. ..... 417/222.2 |

FOREIGN PATENT DOCUMENTS

| | | | |
|---|---|---|---|
| JP | 2005-330855 | A | 12/2005 |
| JP | 2006-22785 | A | 1/2006 |
| KR | 2002-0038464 | A | 5/2002 |

* cited by examiner

OTHER PUBLICATIONS

International Search Report of PCT/KR2006/002565, dated Feb. 26, 2007.

*Primary Examiner* — Natalie Walford
(74) *Attorney, Agent, or Firm* — Hamre, Schumann, Mueller & Larson, P.C.

(57) ABSTRACT

Provided is an oil separating structure of a variable displacement compressor including: a cylinder block having a plurality of cylinder bores; a front housing disposed in the front of the cylinder block to form a swash plate chamber; a drive shaft rotatably supported at the cylinder block; a lug plate disposed in the swash plate chamber of the front housing and fixedly installed at the drive shaft; a rear housing disposed in the rear of the cylinder block and having a discharge chamber and a suction chamber communicating with the cylinder bores; a swash plate installed to be rotated by the lug plate to vary its inclination angle; pistons connected to the swash plate and reciprocating in the cylinder bores; a suction path for communicating the swash plate chamber and the discharge chamber; an additional exhaust path for communicating the swash plate chamber and the suction chamber; and a control valve installed in the middle of the suction path, characterized in that the drive shaft has a communication aperture formed therein for communicating the swash plate chamber and the suction chamber, and the lug plate has a first communication hole passing therethrough and a second communication hole formed therein for communicating the first communication hole and the communication aperture. Therefore, oil and refrigerant are smoothly separated from each other using only the communication hole formed in the lug plate without an additional oil separator, thereby simplifying an inner constitution of a compressor.

3 Claims, 3 Drawing Sheets

[Fig. 1]
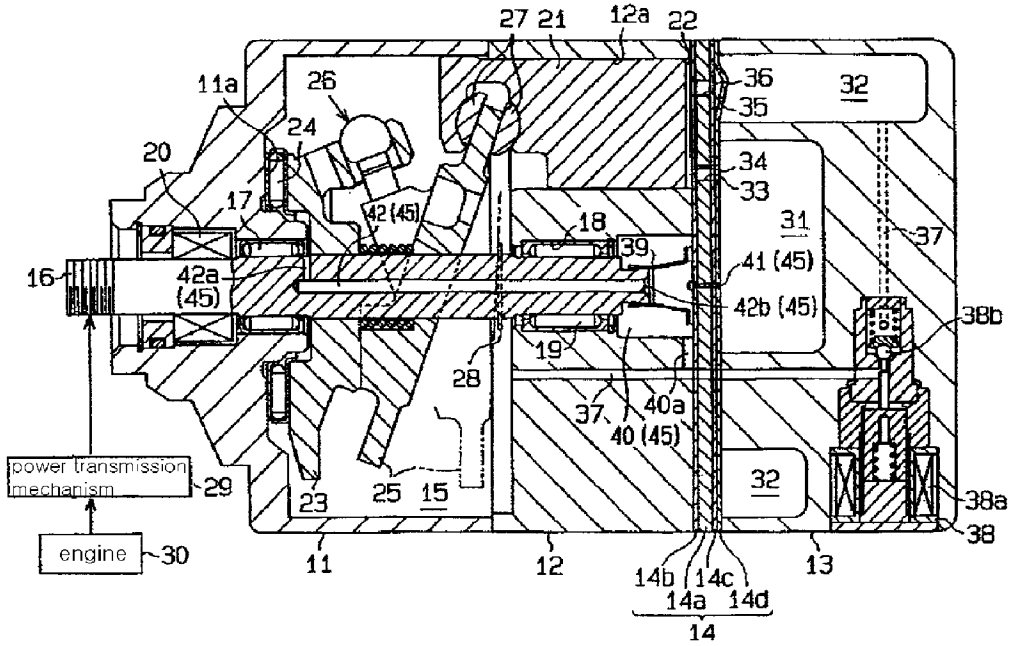
[Fig. 2]
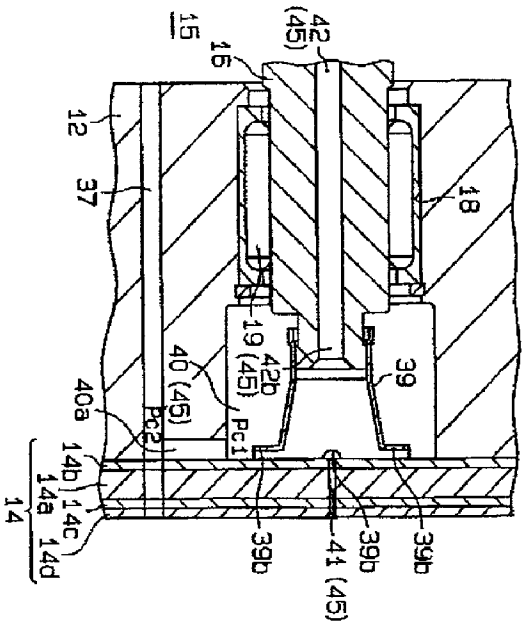

[Fig. 3]
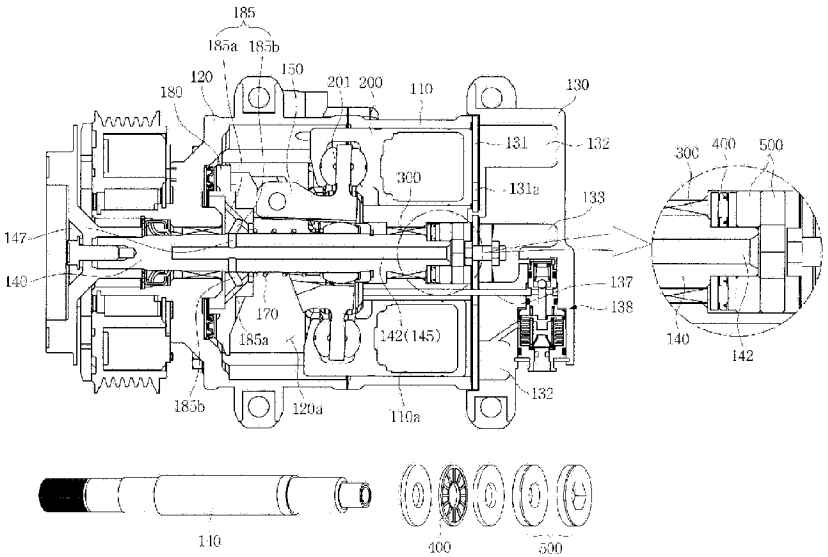
[Fig. 4]
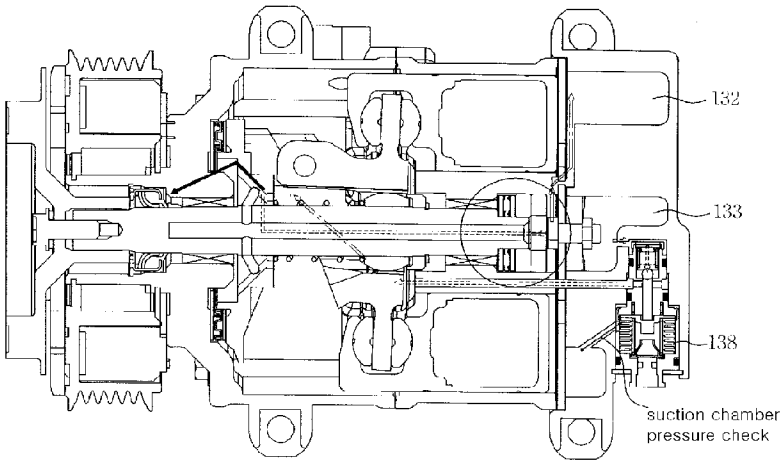

[Fig. 5]
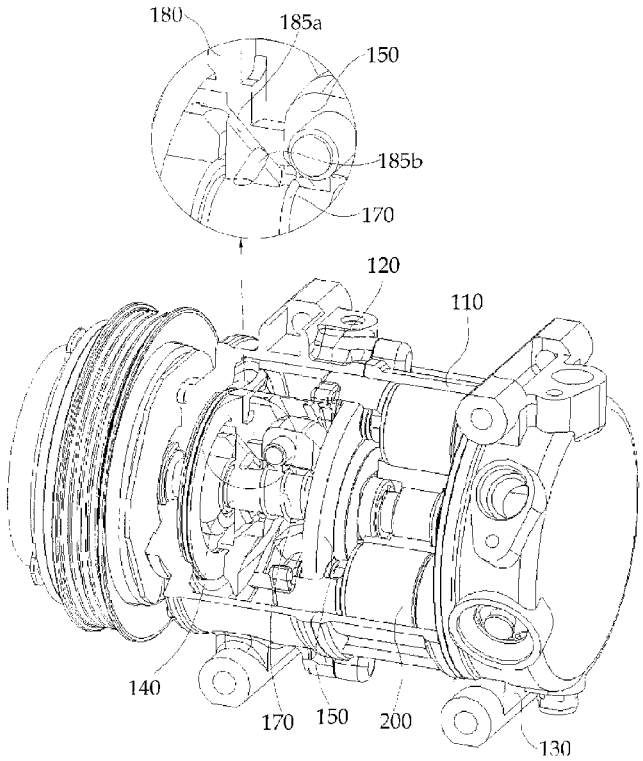
[Fig. 6]
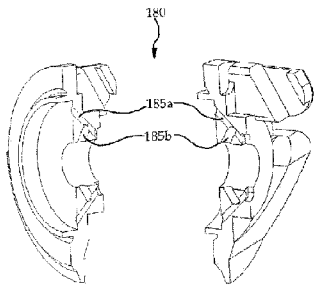
Fig 6-A
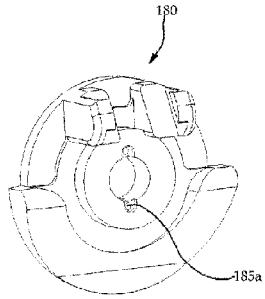
Fig 6-B
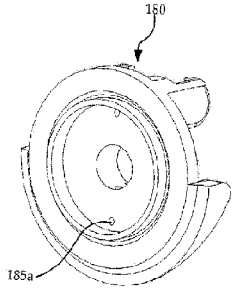
Fig 6-C

OIL SEPARATING STRUCTURE OF VARIABLE DISPLACEMENT COMPRESSOR

TECHNICAL FIELD

The present invention relates to an oil separating structure of a variable displacement compressor, and more particularly, to an oil separating structure of a variable displacement compressor capable of appropriately separating oil and gas from a refrigerant of a swash plate chamber without using separate components.

BACKGROUND ART

Recently, a variable displacement compressor used in an automobile air conditioner is being widely researched. The variable displacement compressor is a device that varies an inclination angle of a swash plate using a control valve and controls the stroke of a piston according to variation in a thermal load to thereby accomplish precise temperature control, and simultaneously, continuously varies the inclination angle to attenuate abrupt torque fluctuation of an engine due to the compressor, thereby enabling a smoother drive.

An example of a conventional variable displacement compressor as described above is disclosed in Korean Patent Publication No. 2002-0038464, and the structure is shown in FIG. 1.

As shown in FIG. 1, the conventional variable displacement compressor includes a cylinder block 12 having a plurality of cylinder bores 12*a* parallelly and longitudinally formed at an inner periphery thereof, a front housing 11 sealed in the front of the cylinder block 12, and a rear housing 13 sealed in the rear of the cylinder block 12 by a valve plate 14*a*.

A swash plate chamber 15 is disposed inside the front housing 11. One end of a drive shaft 16 is rotatably supported adjacent to the center of the front housing 11, and the other end of the drive shaft 16 passes through the swash plate chamber 12 to be supported by a bearing 17 disposed in the cylinder block 12.

In addition, the drive shaft 16 includes a lug plate 23 and a swash plate 25. A spring is interposed between the lug plate 23 and the swash plate 25 to resiliently support the swash plate 25.

The lug plate 23 includes a pair of power transmission support arms integrally projecting from its one surface, each of which has a guide hole punched straight through a center thereof. And, the swash plate 25 has a ball 26 formed at its one side, such that the ball 26 of the swash plate 25 slides in the guide hole of the lug plate 23 as the lug plate 23 rotates, thereby varying the inclination angle of the swash plate 25.

Further, an outer periphery of the swash plate 25 is slidably inserted into each piston 21 via shoes 27.

Therefore, as the swash plate 25 rotates in an inclined state, the pistons 21 inserted into the periphery thereof via the shoe 27 reciprocate in the cylinder bores 12*a* of the cylinder block 12, respectively.

In addition, the rear housing 13 has a suction chamber 31 and a discharge chamber 32, and a valve plate 14*a* interposed between the rear housing 13 and the cylinder block 12 has a suction port 33 and a discharge port 35 corresponding to the cylinder bores 12*a*. The suction chamber 31 and the discharge chamber 32 are connected to the exterior of the compressor through an external refrigerant circuit (not shown).

Meanwhile, an oil separator 39 is installed in the rear of the drive shaft 16 and surrounded by an oil chamber 40. A communication aperture 42 is formed in the drive shaft 16 to connect the swash plate chamber 15 with the oil separator 39. The oil separator 39 has a cylindrical cap shape, and includes a groove 39*b* formed in a circumferential direction thereof.

When the compressor actually operates, pressure in the swash plate chamber 15 is varied in response to manipulation of a control valve 38 (for example, from low pressure to high pressure) so that the refrigerant remaining in the swash plate chamber 15 is discharged to the suction chamber 31 through an additional exhaust path 45.

As described above, the refrigerant gas moves from the swash plate chamber 15 to the suction chamber 31 via the interior of the oil separator 39 through the additional exhaust path 45. At this time, a portion of the refrigerant gas passing through the interior of the oil separator 39, adjacent to an inner periphery of the oil separator 39, is rotated together with the oil separator 39. As a result of the rotation, misty oil contained in the refrigerant gas is centrifugally separated from the refrigerant gas.

As described above, the oil separated by the oil separator 39 slides to a rear end of the oil separator 39 along its inner periphery. Then, the oil is discharged to the exterior of the oil separator 39 through a gap or the groove 39*b* between a front end of the oil separator 39 and a valve/port forming body 14 by means of the centrifugal force due to rotation of the oil separator 39, and stays in an oil chamber 40.

In addition, the oil is continuously introduced into a suction path 37 through a communication path 40*a*, and returned to the swash plate chamber 15 by a flow of the refrigerant gas. Therefore, oil in the swash plate chamber 15 becomes abundant to perform lubrication of the compressor well.

Meanwhile, after separation of oil in the oil separator 39, a portion of the refrigerant gas is introduced into the suction chamber 31 through a path 41, and sequentially passes through a compression chamber 22 and the discharge chamber 32 to be discharged to an external refrigerant circuit.

The above publication discloses various constitutions of the oil separator 39.

However, the conventional variable displacement compressor needs a separate oil separating device such as an oil separator, and a separate space for the oil separator, thereby causing large restriction in design and assembly.

DISCLOSURE OF INVENTION

Technical Problem

In order to solve the foregoing and/or other problems, it is an object of the present invention to provide an oil separating structure of a variable displacement compressor capable of sufficiently performing a function of oil separation without an additional oil separator to provide a simple structure and facilitate assembly.

Technical Solution

One aspect of the present invention provides an oil separating structure of a variable displacement compressor including: a cylinder block having a plurality of cylinder bores; a front housing disposed in the front of the cylinder block to form a swash plate chamber; a drive shaft rotatably supported at the cylinder block; a lug plate disposed in the swash plate chamber of the front housing and fixedly installed at the drive shaft; a rear housing disposed in the rear of the cylinder block and has a discharge chamber and a suction chamber communicating with the cylinder bores; a swash plate installed to be rotated by the lug plate with varying its inclination angle; pistons connected to the swash plate and accommodated in the cylinder bores to reciprocate therein; a suction path for communicating the swash plate chamber and the discharge chamber; an additional exhaust path for communicating the swash plate chamber and the suction chamber; and a control valve installed in the middle of the suction path, characterized in that the lug plate has a communication hole for communicating a connection path of the drive shaft and the swash plate chamber.

In addition, the communication hole formed at the lug plate may include first and second communication holes communicating with each other, the first communication hole may pass through the lug plate, and the second communication hole may connect the connection path and the first communication hole.

Further, the drive shaft may include a sealing member formed at its rear end for sealing between the cylinder block and the drive shaft.

At this time, the sealing member may be a lock nut.

Furthermore, the sealing member may be an oilless bearing.

BRIEF DESCRIPTION OF THE DRAWINGS

FIG. 1 is a longitudinal cross-sectional view of an example of a conventional variable displacement compressor FIG. 2 is a cross-sectional view of the oil separating structure of FIG. 1;

FIG. 3 is a longitudinal cross-sectional view of an oil separating structure of a variable displacement compressor in accordance with the present invention FIG. 4 is a cross-sectional view showing a flow of refrigerant and oil of FIG. 3;

FIG. 5 is a partially-cut perspective view and an enlarged view of an oil separating structure of a variable displacement compressor in accordance with the present invention and FIGS. 6A to 6C are an exploded perspective view, a front perspective view, and a rear perspective view of the structure of a lug plate shown in FIG. 3.

BEST MODE FOR CARRYING OUT THE INVENTION

Exemplary embodiments of the present invention will now be described in detail with reference to the accompanying drawings.

FIGS. 3 to 6 illustrate a variable displacement swash plate type compressor in accordance with an exemplary embodiment of the present invention and its oil separating structure.

As shown, the variable displacement swash plate type compressor includes: a cylinder block 110 having a plurality of cylinder bores 110*a* longitudinally and parallelly formed at its inside, and constituting the exterior of the compressor; a front housing 120 disposed at a front end of the cylinder block 110 and forming a swash plate chamber 120*a*; a drive shaft 140 rotatably supported by the cylinder block 110 and the front housing 120; a lug plate 180 disposed in the swash plate chamber 120*a* of the front housing 120 and fixedly installed at the drive shaft 140*a*; rear housing 130 having a suction chamber 132 and a discharge chamber 133 formed therein and disposed at a rear end of the cylinder block 110; a swash plate 150 having a circular disk shape and rotated by the lug plate 180 to vary its inclination angle; a spring 170 supported between the lug plate 180 and the swash plate 150; and pistons 200 connected to the swash plate 150 and reciprocally accommodated in the cylinder bores 110*a*.

While each piston 200 is slidably engaged with the swash plate 150 via shoe 201, the shoe 201 may be replaced with an elongated connecting rod and a guide groove formed at its one end.

The rear housing 130 includes the suction chamber 132 and the discharge chamber 133, and a valve plate 131 includes a suction port 131*a* for communicating the cylinder bores 110*a* and the suction chamber 132, and a discharge port (not shown) for communicating the cylinder bores 110*a* and the discharge chamber 133.

In addition, a suction valve and a discharge valve are installed respectively in the suction port 131*a* and the discharge port formed at the valve plate 131 to open/close the suction port 131*a* and the discharge port depending on pressure variation due to reciprocation of the pistons 200.

Further, there are a suction path 137 for communicating the swash plate chamber 120*a* and the discharge chamber 133, an additional exhaust path 145 for communicating the swash plate chamber 120*a* and the suction chamber 132, and a control valve 138 installed in the middle of the suction path 137.

Meanwhile, a communication aperture 142 is longitudinally formed in the drive shaft 140 as a portion of the additional exhaust path 145 to communicate the swash plate chamber 120*a* and the suction chamber 132.

A first communication hole 185*a* passes through the lug plate 180 to be in communication with the swash plate chamber 120*a*. A second communication hole 185*b* for communicating the first communication hole 185*a* and the communication aperture 142 is formed in the lug plate 180. The first and second communication holes 185*a* and 185*b* constitute a communication hole 185.

When the communication hole 185 is formed adjacent to the drive shaft 140, it is possible to separate oil using the first communication hole 185*a* only.

In addition, the second communication hole 185*b* and the communication aperture 142 are communicated by a connection aperture 147 of the drive shaft 140.

The communication aperture 142 and the connection aperture 147 constitute a connection path of the drive shaft 140.

Meanwhile, a radial bearing 300 is installed between the drive shaft 140 and the cylinder block 110.

A thrust bearing 400 is installed at the rear end of the drive shaft 140 behind the radial bearing 300 in order to prevent abnormal movement of the drive shaft 140 in an axial direction. The thrust bearing 400 may be a needle bearing, and so on.

However, the refrigerant in the swash plate chamber 120*a* may be directly leaked to the suction chamber 132 through the radial bearing 300 and the thrust bearing 400. Since the refrigerant contains the oil yet, the oil may be introduced into the suction chamber 132 and an external refrigerant circuit to badly affect the compressor.

In order to prevent the introduction of the oil, a sealing member 500 such as a lock nut is installed at the rear of the thrust bearing 400 to seal between the cylinder block 110 and the drive shaft 140. According to the above constitution, it is possible to prevent leakage of the refrigerant through the bearings 300 and 400 as well as securely support the drive shaft 140 in an axial direction.

Of course, the thrust bearing 400 may be supported by the cylinder block 110 only, and a sealing member, without a support function, may be separately installed between the cylinder block 110 and the drive shaft 140 behind the thrust bearing 400.

Hereinafter, operation of the oil separating structure of a variable displacement compressor in accordance with an exemplary embodiment of the present invention will be described.

First, as shown in FIG. 4, when a high pressure refrigerant in the discharge chamber 133 is supplied into the swash plate chamber 120*a* in response to operation of the control valve 138, pressure in the swash plate chamber 120*a* is varied to introduce the refrigerant in the swash plate chamber 120*a* into the suction chamber 132 through the additional exhaust path 145. At this time, the refrigerant contains misty oil.

The refrigerant first passes through the first communication hole 185*a* and the second communication hole 185*b* formed in the lug plate 180 as a portion of the additional exhaust path 145. In this case, the oil and refrigerant gas are separated from each other by the centrifugal force due to rotation of the lug plate 180. The oil is stuck to the first communication hole 185*a* to be slidably supplied into the swash plate chamber 120*a*, and the refrigerant gas is discharged to the low-pressure suction chamber 132 through the second communication hole 185*b*. Therefore, the oil in the swash plate chamber 120*a* becomes abundant to perform lubrication of the compressor well.

As described above, it is possible to perform smooth separation of the oil through the communication hole formed in the lug plate, without an additional oil separator.

INDUSTRIAL APPLICABILITY

As can be seen from the foregoing, since oil and refrigerant are smoothly separated from each other using only a communication hole formed in a lug plate without an additional oil separator, an inner constitution of a compressor is very simple.

The invention claimed is:

1. An oil separating structure of a variable displacement compressor, comprising:

a cylinder block having a plurality of cylinder bores;

a front housing disposed in the front of the cylinder block to form a swash plate chamber;

a drive shaft rotatably supported at the cylinder block;

a lug plate disposed in the swash plate chamber of the front housing and fixedly installed at the drive shaft;

a rear housing disposed in the rear of the cylinder block and having a discharge chamber and a suction chamber communicating with the cylinder bores;

a swash plate installed to be rotated by the lug plate to vary its inclination angle;

pistons connected to the swash plate and reciprocating in the cylinder bores;

a suction path for communicating the swash plate chamber and the discharge chamber;

an additional exhaust path for communicating the swash plate chamber and the suction chamber; and a control valve installed on the way of the suction path, the lug plate having first and second communication holes communicating with each other through the lug plate, the second communication hole connecting the first communication hole to a connection path of the drive shaft.

2. The oil separating structure of a variable displacement compressor according to claim 1, wherein a thrust bearing is disposed at the cylinder block behind the drive shaft, the drive shaft comprises a sealing member formed at its rear end for sealing between the cylinder block and the drive shaft.

3. The oil separating structure of a variable displacement compressor according to claim 2, wherein the sealing member is a lock nut.

* * * * *